US009903213B2

(12) United States Patent
Bluck et al.

(10) Patent No.: US 9,903,213 B2
(45) Date of Patent: Feb. 27, 2018

(54) TURBOMACHINE ROTOR BLADE, TURBOMACHINE ROTOR DISC, TURBOMACHINE ROTOR, AND GAS TURBINE ENGINE WITH DIFFERENT ROOT AND SLOT CONTACT FACE ANGLES

(71) Applicant: Siemens Aktiengesellschaft, Munich (DE)

(72) Inventors: Richard Bluck, Lincoln (GB); David Butler, Nottingham (GB); David Overton, Lincoln (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 178 days.

(21) Appl. No.: 14/763,756

(22) PCT Filed: Feb. 3, 2014

(86) PCT No.: PCT/EP2014/051995
§ 371 (c)(1),
(2) Date: Jul. 27, 2015

(87) PCT Pub. No.: WO2014/118358
PCT Pub. Date: Aug. 7, 2014

(65) Prior Publication Data

US 2015/0361803 A1 Dec. 17, 2015

(30) Foreign Application Priority Data

Feb. 4, 2013 (EP) ..... 13153863

(51) Int. Cl.
*F01D 5/30* (2006.01)
*F01D 5/02* (2006.01)

(52) U.S. Cl.
CPC ..... *F01D 5/3007* (2013.01); *F01D 5/02* (2013.01); *F01D 5/30* (2013.01); *F05D 2200/33* (2013.01); *F05D 2250/38* (2013.01)

(58) Field of Classification Search
CPC . F01D 5/30; F01D 5/3007; F01D 5/02; F05D 2250/38
See application file for complete search history.

(56) References Cited

U.S. PATENT DOCUMENTS 2,429,215 A * 10/1947 Boestad ..... F01D 5/3007 416/216
3,045,968 A * 7/1962 Willis ..... F01D 5/3007 416/216

(Continued)

FOREIGN PATENT DOCUMENTS

CA 484140 A 6/1952
CH 240283 A 12/1945

(Continued)

OTHER PUBLICATIONS

JP Office Action dated Jan. 30, 2017, for JP patent application No. 2015-555738.

(Continued)

*Primary Examiner* — Mark Laurenzi
*Assistant Examiner* — Xiaoting Hu
(74) *Attorney, Agent, or Firm* — Beusse Wolter Sanks & Maire

(57) ABSTRACT

A turbomachine rotor blade has a firtree shaped root, to be secured in a rotor disc rotatable around a rotor axis. In a plane perpendicular to the rotor axis, the root has a first, second, and third root lobe with a first, second, and third root contact face. Each of the first, second, and third root contact face is angled relative to a radial root bottom axis with a first, second, and third root angle, respectively. The first root angle is smaller than the second and the second root angle (Continued)

is substantially equal to the third. A turbomachine rotor disc has a firtree shaped slot having a first, second, and third slot angle, the first slot angle being smaller than the second and the second slot angle being substantially equal to the third. A gas turbine engine has the turbomachine rotor herein.

21 Claims, 4 Drawing Sheets

(56) References Cited

U.S. PATENT DOCUMENTS

| | | | | |
|---|---|---|---|---|
| 3,908,447 | A | 9/1975 | Salt | |
| 4,260,331 | A * | 4/1981 | Goodwin | F01D 5/3007 416/219 R |
| 4,338,706 | A | 7/1982 | Aoki | |
| 4,533,298 | A * | 8/1985 | Partington | F01D 5/225 416/191 |
| 4,692,976 | A * | 9/1987 | Andrews | F01D 5/3007 29/557 |
| 4,824,328 | A * | 4/1989 | Pisz | F01D 5/3007 416/219 R |
| 5,110,262 | A * | 5/1992 | Evans | F01D 5/3007 416/219 R |
| 5,147,180 | A * | 9/1992 | Johnson | F01D 5/3007 416/219 R |
| 5,176,500 | A * | 1/1993 | Heinig | F01D 5/3007 416/219 R |
| 5,480,285 | A * | 1/1996 | Patel | F01D 5/141 416/223 A |
| 5,554,005 | A * | 9/1996 | Nguyen | F01D 5/3007 416/219 R |
| 5,741,119 | A | 4/1998 | Heppenstall | |
| 6,019,580 | A * | 2/2000 | Barr | F01D 5/3007 415/170.1 |
| 7,794,208 | B2 * | 9/2010 | Suzuki | F01D 5/06 416/219 R |
| 7,874,806 | B2 | 1/2011 | Phipps | |
| 7,905,709 | B2 * | 3/2011 | Lagrange | F01D 5/3007 416/219 R |
| 8,047,796 | B2 * | 11/2011 | Riaz | F01D 5/3007 416/215 |
| 8,079,817 | B2 * | 12/2011 | Lagrange | F01D 5/3007 416/219 R |
| 8,210,822 | B2 * | 7/2012 | DeMania | F01D 5/3007 416/219 R |
| 2003/0068197 | A1 * | 4/2003 | Pinzauti | F01D 5/3007 403/345 |
| 2007/0237644 | A1 * | 10/2007 | Suzuki | F01D 5/3007 416/220 R |
| 2008/0050238 | A1 * | 2/2008 | Durocher | F01D 5/3007 416/219 R |
| 2009/0022591 | A1 * | 1/2009 | Mujezinovic | F01D 5/3007 416/219 R |
| 2009/0022595 | A1 * | 1/2009 | Cosi | F01D 5/30 416/223 A |
| 2014/0083114 | A1 * | 3/2014 | Beattie | F01D 5/3007 60/806 |

FOREIGN PATENT DOCUMENTS

| | | | |
|---|---|---|---|
| DE | 889159 | C | 9/1953 |
| EP | 2436883 | A1 | 4/2012 |
| GB | 677142 | A | 8/1952 |
| GB | 2030657 | A | 4/1980 |
| JP | S55136304 | U | 9/1980 |
| JP | S5758701 | U | 4/1982 |
| RU | 2302532 | C2 | 7/2007 |
| WO | 9942703 | A1 | 8/1999 |

OTHER PUBLICATIONS

JP Office Action dated Jul. 4, 2016, for JP application No. 2015-555738.

RU Office Action dated Dec. 1, 2016, for RU patent application No. 2015132428.

JP Notice of Allowance dated Aug. 21, 2017, for JP patent application No. 2015-555738.

* cited by examiner

TURBOMACHINE ROTOR BLADE, TURBOMACHINE ROTOR DISC, TURBOMACHINE ROTOR, AND GAS TURBINE ENGINE WITH DIFFERENT ROOT AND SLOT CONTACT FACE ANGLES

CROSS REFERENCE TO RELATED APPLICATIONS

This application is the US National Stage of International Application No. PCT/EP2014/051995 filed Feb. 3, 2014, and claims the benefit thereof. The International Application claims the benefit of European Application No. EP13153863 filed Feb. 4, 2013. All of the applications are incorporated by reference herein in their entirety.

FIELD OF THE INVENTION

The present invention relates generally to the design of a turbomachine rotor. More specifically, it relates to an improved set of contact face angles of roots of a turbomachine rotor blade and to an improved set of contact face angles of slots of a turbomachine rotor disc.

BACKGROUND OF THE INVENTION

A turbomachine rotor typically comprises a plurality of blades, a rotor axis and a rotor disc. A blade typically comprises an aerofoil, a platform and a root. A blade is also called a rotor blade or a rotor blade assembly. The root of the blade is used for joining the blade and the rotor disc and making sure that the blade is fixed to the rotor disc in both idle state and operating mode of the turbomachine.

There exist different ways for joining the blade and the rotor disc. One way is the provision of mounting grooves or slots in a radially outward section of the rotor disc. The root of the blade is inserted, e.g. slid in the slot. By choosing a shape of the root that corresponds to the shape of the slot, a secure and resilient joint can be achieved.

It is known to use a firtree shape for the profile of the root of the rotor blade and the corresponding slot of the rotor disc. Such a profile provides an accurate placement of the blade with respect to the rotor disc. Furthermore, firtree profiles are relatively strong to withstand the radially outward, i.e. centrifugal, forces imposed on the blade during rotation of the rotor disc together with its attached blades. However, after a certain lifetime of the root, the root may break due to the stress and the mechanical load, particularly at sections that are in physical contact with the slot surfaces in the rotor disc. Alternatively, there may also be damages and breakage at the slot surfaces or the adjacent sections of the rotor disc, particularly again at or near these sections that are in physical contact with the root of the rotor blade.

Thus there exists the goal to optimise the distribution of the stress and the mechanical load across the root and across the slot surfaces. More specifically, the distribution of the stress and the mechanical load across the contact faces between the root and the slot shall be optimised.

SUMMARY OF THE INVENTION

This objective is achieved by the independent claims. The dependent claims describe advantageous developments and modifications of the invention.

In accordance with aspects of the invention there is provided a turbomachine rotor blade with a firtree shaped root.

The root comprises at least one root side, the side comprising at least three root lobes, each root lobe comprising a root contact face. Each of the root contact faces has an inclination against a common axis of reference, the inclination being characterised by a root angle. The invention shows that by choosing these root angles under certain boundary conditions, the distribution of stress on the root lobes can be optimised and thus the risk of damage and/or breakage of a root lobe can be minimised.

A contact face angle of a root contact face is called a root angle; a contact face angle of a slot contact face is called a slot angle.

The invention also encompasses transferring this principle from root lobes to slot lobes, wherein the slot can be described as a gap or slit of a turbomachine rotor disc.

Finally, the invention also discloses a turbomachine rotor with a reduced risk of damage and/or breakage comprising a turbomachine rotor blade and a turbomachine rotor disc, both exhibiting root angles and slot angles, respectively, which are chosen considering the boundary conditions which are mentioned above and will be presented in more detail below. Furthermore, the invention is also directed towards a gas turbine engine comprising a turbomachine rotor as defined above.

In one aspect of the present invention there is provided a turbomachine rotor blade with a firtree shaped root, arranged to be secured in a rotor disc, the rotor disc being rotatable around a rotor axis, wherein in a plane perpendicular to the rotor axis. The root comprises a root bottom and a root side. The root side comprises a plurality of root lobes, each of the root lobes comprises a root contact face, arranged to be in physical contact with a slot contact face of the rotor disc. The plurality of root lobes comprises a first root lobe with a first root contact face, a second root lobe with a second root contact face and a third root lobe with a third root contact face, the first root lobe being closer to the root bottom than the second root lobe and the second root lobe being closer to the root bottom than the third root lobe. The first root contact face is angled relative to a radial root bottom axis with a first root angle, the radial root bottom axis being defined by a line through the rotor axis and the root bottom. The second root contact face is angled relative to the radial root bottom axis with a second root angle; and the third root contact face is angled relative to the radial root bottom axis with a third root angle. Any one or more of the first root angle or the second root angle or the third root angle is in the range 1° to 15° of any of the other root angles.

In particular, any one or more of the first root angle or the second root angle or the third root angle is in the range 1° to 5° of any of the other root angles.

The first root angle may be smaller than or greater than the second root angle and the second root angle may be substantially equal to the third root angle.

The first root angle may be approximately 2° smaller than or greater than the second root angle or third root angle.

The first root angle may be approximately 2° smaller than or greater than the second root angle and the second root angle may be equal to the third root angle.

In another aspect of the present invention there is provided a turbomachine rotor disc with a firtree shaped slot, the rotor disc being rotatable around a rotor axis; wherein in a plane perpendicular to the rotor axis. The slot comprises a slot bottom and a slot side. The slot side comprises a plurality of slot lobes, each of the slot lobes comprises a slot contact face, arranged to be in physical contact with a root contact face of a turbomachine rotor blade. The plurality of slot lobes comprises a first slot lobe with a first slot contact face, a second slot lobe with a second slot contact face and a third slot lobe with a third slot contact face, the first slot lobe being closer to the slot bottom than the second slot lobe and the second slot lobe being closer to the slot bottom than the third slot lobe. The first slot contact face is angled relative to a radial slot bottom axis with a first slot angle, the radial slot bottom axis being defined by a line through the rotor axis and the slot bottom. The second slot contact face is angled relative to the radial slot bottom axis with a second slot angle; and the third slot contact face is angled relative to the radial slot bottom axis with a third slot angle. Any one or more of the first slot angle or the second slot angle or the third slot angle is in the range 1 to 15 of any of the other slot angles.

In particular, any one or more of the first slot angle or the second slot angle or the third slot angle is in the range 1° to 5° of any of the other slot angles.

The first slot angle may be smaller than or greater than the second slot angle and the second slot angle is substantially equal to the third slot angle.

The first slot angle may be approximately 2° smaller than or greater than the second slot angle or third slot angle.

The first slot angle is approximately 2° smaller than or greater than the second slot angle and the second slot angle is equal to the third slot angle.

One aspect of the invention is the turbomachine rotor blade, particularly a gas turbine rotor blade, the turbomachine rotor blade also being denoted as blade for sake of simplicity in the following. The blade includes a firtree shaped root and is arranged to be secured in a rotor disc. The rotor disc is rotatable around a rotor axis, which particularly acts as an axis of rotation of the disc. In a plane perpendicular to the rotor axis, the root comprises a root bottom and a root side. The root side comprises a plurality of root lobes, each of the root lobes comprises a root contact face, arranged to be in physical contact with a slot contact face of the rotor disc. The plurality of root lobes comprises a first root lobe with a first root contact face, a second root lobe with a second root contact face and a third root lobe with a third root contact face. The first root lobe is closer to the root bottom than the second root lobe and the second root lobe is closer to the root bottom than the third root lobe. Furthermore, the root features a radial root bottom axis—which is fictive—and which is defined by a line through the rotor axis and the root bottom.

The first root contact face is angled relative to the radial root bottom axis with a first root angle, the second root contact face is angled relative to the radial root bottom axis with a second root angle, and the third root contact face is angled relative to the radial root bottom axis with a third root angle. According to the invention the turbomachine rotor blade is characterised in that the first root angle is smaller than the second root angle and the second root angle is substantially equal to the third root angle.

A turbomachine is a machine that transfers energy between a rotor and a fluid. More specifically, it transfers energy between a rotational movement of a rotor and a lateral flow of a fluid. A first type of a turbomachine is a turbine, e.g. a turbine section of a gas turbine engine. A turbine transfers energy from a fluid to a rotor. A second type of a turbomachine is a compressor, e.g. a compressor section of a gas turbine engine. A compressor transfers energy from a rotor to a fluid.

A turbomachine comprises a rotor, which is a rotary mechanical device that rotates around an axis of rotation. A turbomachine may comprise in addition a stator and a casing.

A turbomachine rotor may comprise a plurality of blades, a rotor axis and a rotor disc. The blade may comprise several blade components such as an aerofoil, a platform and a root. The blade can be made in one piece or can be composed of blade components which are interconnected with each other.

Obviously, a blade is a three-dimensional object. As the blade is arranged to be secured or fixed in a rotor disc, which is rotatable around a rotor axis, a plane can be established that is perpendicular to the rotor axis and intersects the blade. Therefore, a two-dimensional analysis of the blade can be conducted. Obviously again, many of such planes do exist. However, only some of the planes fulfil the requirements regarding their contact face angles described above. According to the invention the blade has to exhibit at least one plane perpendicular to the rotor axis where these requirements are fulfilled.

The root bottom of the blade is defined as the section of the root that is closest to the rotor axis, when the root is mounted in the rotor disc.

Even though the inventive concept will be explained in a cross-sectional view, it should be stressed that in general the blade has an axial expansion. This axial, wherein axial is referred to the rotor axis, expansion can be such that a projection of the blade in axial direction is identical to a cross section of the blade in a plane perpendicular to the rotor axis. The axial expansion of the blade can alternatively also be such that the blade, particularly its root, is curved or wound with regard to the axial direction and thus a projection of the blade in axial direction is different to a cross section of the blade in a plane perpendicular to the rotor axis. In the following, always a cross section of the root in a plane perpendicular to the rotor axis will be described.

The root bottom can be a distinct point. If the section of the root which is closest to the rotor axis, which is called root bottom section, is curved concavely, the root bottom can also be represented by a line segment. If the root comprises a duct, a conduit or similar feature, particularly in the root bottom section, such duct, conduit or similar feature shall not taken into account when defining the root bottom.

The root comprises at least one root side. The root side particularly covers the whole section from the root bottom to the most distal point—with regard to the rotor axis—of the root. If, as an example, a platform adjoins the root, the root side is limited by the platform. If, as another example, a blade is adjacent to the root, the root side is limited by the blade. Furthermore, the root side has a surface which is oriented circumferentially with regard to the rotor axis.

The root side comprises at least three root lobes. A lobe, also referred to as lug or corner or tooth in the literature, may have a convex surface section and/or a concave surface section and/or a planar surface section.

A root lobe may be defined by an area surrounded from the following line segments: (a) the surface section in-between a radially inward local root distance minimum—whereby a root distance is defined by a length of a root distance line segment between a surface section of the root and an axis section of the radial root bottom axis, a local root distance minimum signifies a local minimum of the root distance, and a radially inward local root distance minimum signifies a local root distance minimum that is closer to the rotor axis, i.e. radially more inward, compared to another local root distance minimum—and a radially outward local root distance minimum, the radially inward local root distance minimum and the radially outward local root distance minimum being two adjacent local root distance minima, (b) a root distance line segment of the radially inward local root distance minimum, (c) a root distance line segment of the radially outward local root distance minimum, and finally (d) a projected root lobe line segment, which is a projection of the surface section in-between the radially inward local root distance minimum and the radially outward local root distance minimum to the radial root bottom axis. The root line segment and the root distance line segment are each perpendicular to the radial root bottom axis. In other words, the root lobe is a region between two adjacent indentations of the surface of the root side.

If the root bottom is a point, the root bottom and the radially inward local root distance minimum coincide for the innermost root lobe. If the root bottom is a line segment, it is defined that for the innermost root lobe the surface section, that is partially limiting the innermost root lobe, is limited by the radially outward local root distance minimum and an intersection of the radial root bottom axis and the root bottom.

Obviously, on a microscopic scale the root side has a plurality of "microscopic local minima" due to a roughness of the surface, micro cracks, etc. However, when defining the limits of a root lobe, no microscopic local minima, but only local minima on a macroscopic scale shall be taken into account.

Each root lobe comprises a so-called root contact face—e.g. first, the second or the third root contact face—, which is arranged to be in physical contact with a corresponding slot contact face. The root contact face is part of the surface section of the root lobe. When the blade including the root is joined with the rotor disc and the turbomachine rotor comprising the blade and the rotor disc is in operation, radial—i.e. centrifugal—forces arise. These radial forces cause a pressure from sections of the root to sections of the slot surface. The surface sections where this pressure occurs are called contact faces. Other sections of the surface of a root lobe can be in physical contact with sections of the surface of a slot, too, particularly when the turbomachine rotor is not in operation, i.e. not in rotation. However, as described, only these sections of the surface are denoted as contact faces where a pressure due to radial forces during the operation of the turbomachine rotor occurs.

The root contact face is a planar section of the root surface section. Thus, a contact face angle can be assigned to each contact face. The contact face angle is determined relative to the radial root bottom axis. Obviously, there always exist two angles at an intersection of the radial root bottom axis and a line extending from the contact face. These two angles consist of a first angle and a second angle. The sum of the first angle and the second angle is 180°. In the context of this application, the first angle is denoted as the root angle if the first angle is smaller or equal to the second angle and the second angle is denoted as the root angle if the second angle is smaller than the first angle.

The root side comprises at least three root lobes, the three root lobes being denoted as the first root lobe, the second root lobe and the third root lobe.

In general, the distance from a root lobe to the root bottom may be determined by the projected root lobe line segment, which is a part of the radial root bottom axis. The distance of a centre of the projected root lobe line segment to the root bottom is called the distance from the root lobe to the root bottom.

Out of the three root lobes, the first root lobe is closest to the root bottom, i.e. the distance of the first root lobe to the root bottom is smaller than the distance of the second root lobe to the root bottom. Furthermore, the third root lobe is further away from the root bottom than the second root lobe, implying that it is closer to the aerofoil than the second root lobe.

The invention discloses boundary conditions for the contact face angles which allow for an optimised distribution of the stress across the root lobes, particularly during operation of the turbomachine rotor. The boundary conditions include the requirement that the first contact face angle shall be smaller than the second contact face angle and that the second contact face angle shall be substantially equal to the third contact face angle.

The fact that the first contact face angle is smaller than the second and the third contact face angle is particularly beneficial for the distribution of the stress during operation. In this way, when the turbomachine rotor commences rotation, the main pressure may at first be exerted on the second and the third contact faces. Only after a certain while, pressure in a significant extent may also be exerted on the first contact face.

The second root angle and the third root angle are substantially equal according to the invention. One of the advantages thereof is a simplified assembly and manufacturing. "Substantially equal" contact face angles comprise contact face angles which may deviate from each other within manufacturing tolerances. The second contact face angle and the third contact face angle shall not deviate from each other more than 5°, particularly not more than 2°, particularly not more than 1°.

It should be mentioned that it may be advantageous if the root side comprises more than three root lobes. If the root side comprises a fourth root lobe, the fourth root lobe may be located adjacent to one or two of the three root lobes already mentioned. Obviously, a root side may also comprise five or more root lobes.

Apart from the root side, which comprises a plurality of root lobes in a plane perpendicular to the rotor axis, in a first embodiment the root may comprise a further root side in the same plane. It can be said that the root side and the further root side are circumferentially opposite to each other, wherein the circumference referred to is the circumference of the rotor disc where the blade is joined with.

The further root side may comprise a convex surface section and/or a concave surface section and/or a planar surface section. The root side may also comprise a plurality of further root lobes.

In other words this means that there exists a plane perpendicular to the rotor axis, where the profile of the root has a root side—acting as a first root side-comprising a plurality of root lobes and a further root side—acting as a second root side—comprising a plurality of further root lobes.

In a further embodiment, the plurality of root lobes comprises a first root shape, the plurality of further root lobes comprises a second root shape and the first root shape is a copy, flipped at the radial root bottom axis, of the second root shape.

Each root lobe can be assigned a root lobe shape. The root lobe shape is determined by the surface section of the root lobe. The root lobe shape may, described in the direction from the section closest to the root bottom to the section most distal from the root bottom, first comprise a concave surface section, followed a convex surface section comprising a point being most distal to the radial root bottom axis, followed by a planar surface section, which represents the contact surface of the root lobe, finally followed again by a concave surface section.

The aggregate of all root lobe shapes of the root side is denoted by the first root shape. The aggregate of all root lobe shapes of the further root side is denoted by the second root shape.

Figuratively speaking, the first root shape and the second root shape may together have a shape similar to a fir tree.

The first root shape may be a copy of the second root shape, solely flipped at the radial root bottom axis. In other words, the first root shape is mirror-symmetrical to the second root shape, the axis of symmetry being the radial root bottom axis.

An advantage of such a root shape is its easy and affordable way of manufacturing it. The root lobes may be grinded into the root side by a milling machine. If the first and the second root shape are similar to each other, the grinding process is substantially simplified.

In a further embodiment, the maximum root distance of the first root lobe is smaller than the maximum root distance of the second root lobe and/or the maximum root distance of the second root lobe is smaller than the maximum root distance of the third root lobe.

One of the advantages of such an assembly of root lobes is that the overall mechanical load is distributed across the different root lobes in an optimised manner.

The blade described above may be utilised as part of a gas turbine engine, also denoted by a gas turbine or a combustion turbine. A gas turbine engine is a type of an internal combustion engine. It has an upstream rotating compressor section coupled to a downstream turbine section, and a combustion chamber in-between.

In particular, the blade may be part of the compressor section of the gas turbine engine. Additionally or instead, it may also be part of the turbine section of the gas turbine engine.

Another aspect of the invention is directed towards the turbomachine rotor disc, also denoted by rotor disc. The rotor disc includes a firtree shaped slot and is rotatable around its rotor axis. In a plane perpendicular to the rotor axis, the slot comprises a slot bottom and a slot side. The slot side comprises a plurality of slot lobes, each of the slot lobes comprises a slot contact face, arranged to be in physical contact with a root contact face of the rotor disc. The plurality of slot lobes comprises a first slot lobe with a first slot contact face, a second slot lobe with a second slot contact face and a third slot lobe with a third slot contact face. The first slot lobe is closer to the slot bottom than the second slot lobe and the second slot lobe is closer to the slot bottom than the third slot lobe. The first slot contact face is angled relative to a radial slot bottom axis—defined by a line through the rotor axis and the slot bottom—with a first slot angle, the second slot contact face is angled relative to the radial slot bottom axis with a second slot angle, and the third slot contact face is angled relative to the radial slot bottom axis with a third slot angle. The turbomachine rotor disc is characterised in that the first slot angle is smaller than the second slot angle and that the second slot angle is substantially equal to the third slot angle.

A slot may be defined as the slit or gap in the radially outward section of the rotor disc. Except for the slots, the rotor disc may exhibit an idealised cylindrical shape. It has to be stressed that the slot comprises the "empty space" in the radially outward section of the rotor disc and the surface section of the rotor disc adjacent to this "empty space".

The definition of a slot lobe is similar to the definition of a root lobe. A slot lobe is defined by a fictive area surrounded from the following fictive line segments: (a) the surface section in-between a radially inward local slot distance minimum—whereby a slot distance is defined by a length of a slot distance line segment between a surface section of the slot and an axis section of the radial root bottom axis, a local slot distance minimum signifies a local minimum of the slot distance, and a radially inward local slot distance minimum signifies a local slot distance minimum that is closer to the rotor axis, i.e. radially more inward, compared to another local slot distance minimum—and a radially outward local slot distance minimum, the radially inward local slot distance minimum and the radially outward local slot distance minimum being two adjacent local slot distance minima, (b) a slot distance line segment of the radially inward local slot distance minimum, (c) a slot distance line segment of the radially outward local slot distance minimum, and finally (d) a projected slot lobe line segment, which is a projection of the surface section in-between the radially inward local slot distance minimum and the radially outward local slot distance minimum to the radial slot bottom axis. The slot line segment and the slot distance line segment are each perpendicular to the radial slot bottom axis. In other words, the slot lobe is a region between two adjacent indentations of the surface of the slot side.

If the slot bottom is a point, the slot bottom and the radially inward local slot distance minimum coincide for the innermost slot lobe. If the slot bottom is a line segment—i.e. a convex disc surface section at the slot bottom—, it is defined that for the innermost slot lobe the surface section that is partially limiting the innermost slot lobe, is limited by the radially outward local slot distance minimum and an intersection of the radial slot bottom axis and the slot bottom.

Obviously, on a microscopic scale the slot side has a plurality of "microscopic local minima" due to a roughness of the surface, micro cracks, etc. However, when defining the limits of a slot lobe, no microscopic local minima, but only local minima on a macroscopic scale shall be taken into account.

Thus, by applying the idea of the invention to a slot in a rotor disc, the slot is designed analogously to the firtree shaped root in the blade. The same concept of the invention applies: By choosing the slot angles taking into account certain boundary conditions, the distribution of stress on the slot contact faces can be optimised and thus the risk of damage and/or breakage of a slot contact face can be minimised.

In an embodiment, the slot comprises a further slot side, the further slot side comprising a plurality of further slot lobes, and the slot side—acting as a first slot side—and the further slot side—acting as a second slot side—are circumferentially opposite to each other.

A first advantage of having a further slot side with a plurality of further slot lobes circumferentially opposite to the slot side with the plurality of slot lobes is on the one hand the increased stability of the joint between the blade and the rotor disc. A second advantage is the potentially better distribution of stress and mechanical load across an increased number of slot contact faces.

Another embodiment comprises a first slot shape being a copy, flipped at the radial slot bottom axis, of a second slot shape.

In analogy to the mirror-symmetrical pairs of root lobes, mirror-symmetrical pairs of slot lobes feature important advantages, too. This time, each slot lobe exhibits a slot lobe shape and the first slot shape is comprised by slot lobe shapes of the slot lobes while the second slot shape is comprised by slot lobe shapes of the further slot lobes.

Again, advantages arise for example from cost reductions in manufacturing the slots.

In a further embodiment, the maximum slot distance of the first slot lobe is smaller than the maximum slot distance of the second slot lobe and/or the maximum slot distance of the second slot lobe is smaller than the maximum slot distance of the third slot lobe.

Such an assembly of the slot lobes has the advantage that the overall mechanical load is distributed across the different slot lobes in an optimised manner.

In an embodiment, a gas turbine engine comprises the rotor disc. Particularly, the rotor disc may be part of the compressor section and/or the turbine section of the gas turbine engine.

It should be stressed, that the details, advantages and constructional varieties described for a root of a blade are in general also valid for a slot of a rotor disc and vice versa.

Another aspect of the invention relates to a turbomachine rotor which comprises a turbomachine rotor blade and a turbomachine rotor disc. The root of the blade and the slot of the rotor disc exhibit a root shape and a slot shape, respectively, that correspond with each other. Both shapes can be nearly identical. Alternatively, the two shapes can also deliberately deviate from each other in certain aspects. In particular, it can be beneficial that, during operation of the turbomachine rotor, the corresponding contact faces of the root and the slot are in close contact, while the corresponding residual surface sections exhibit at least partially a gap in-between them. Thereby, for example, a different thermal expansion of the root and the slot due to a different thermal expansion coefficient or due to different temperatures of the root and the slot can be compensated.

In an embodiment a physical contact between the contact face of a root lobe and the contact face of a slot lobe is established during operation of the turbomachine rotor.

In idle state, i.e. when the turbomachine rotor stands still and no radial—i.e. centrifugal—forces are exerted on the components such as the root(s) and the slot(s), a gap between the contact face of a root lobe and the contact face of a slot lobe may be present. When the turbomachine rotor starts rotating, the centrifugal force pushes or presses the blade with its root including its root lobes radially outward towards the slot contact faces. The magnitude of the centrifugal force, that a lobe experiences, depends, amongst other factors, on the shape of the lobe, in particular on the angle of the contact face. The magnitude of the centrifugal force exerted on the radially innermost lobe is reduced when the contact face angle is decreased compared to a contact face angle equal to the contact face angle of the adjacent lobe.

A last aspect of the invention relates to a gas turbine engine which comprises a turbomachine rotor with the features described above. A gas turbine engine can e.g. be used in aviation, passenger surface vehicles, ships, as mechanical drive and coupled with an electrical generator.

This invention is directed to mount parts intended to be rotated around an axis to a part that carries the mounted part. This applies for examples for rotor blades in steam turbines or gas turbines. The invention may in principle also be used in other rotating machines, like motors or compressors. Besides, the inventive blade root can also be used for mounting non-rotating stator vanes, even though the problem with centrifugal forces does not exist for non-rotating devices.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematically. It is noted that for similar or identical elements in different figures, the same reference signs will be used.

DETAILED DESCRIPTION OF THE INVENTION

Figure 1:
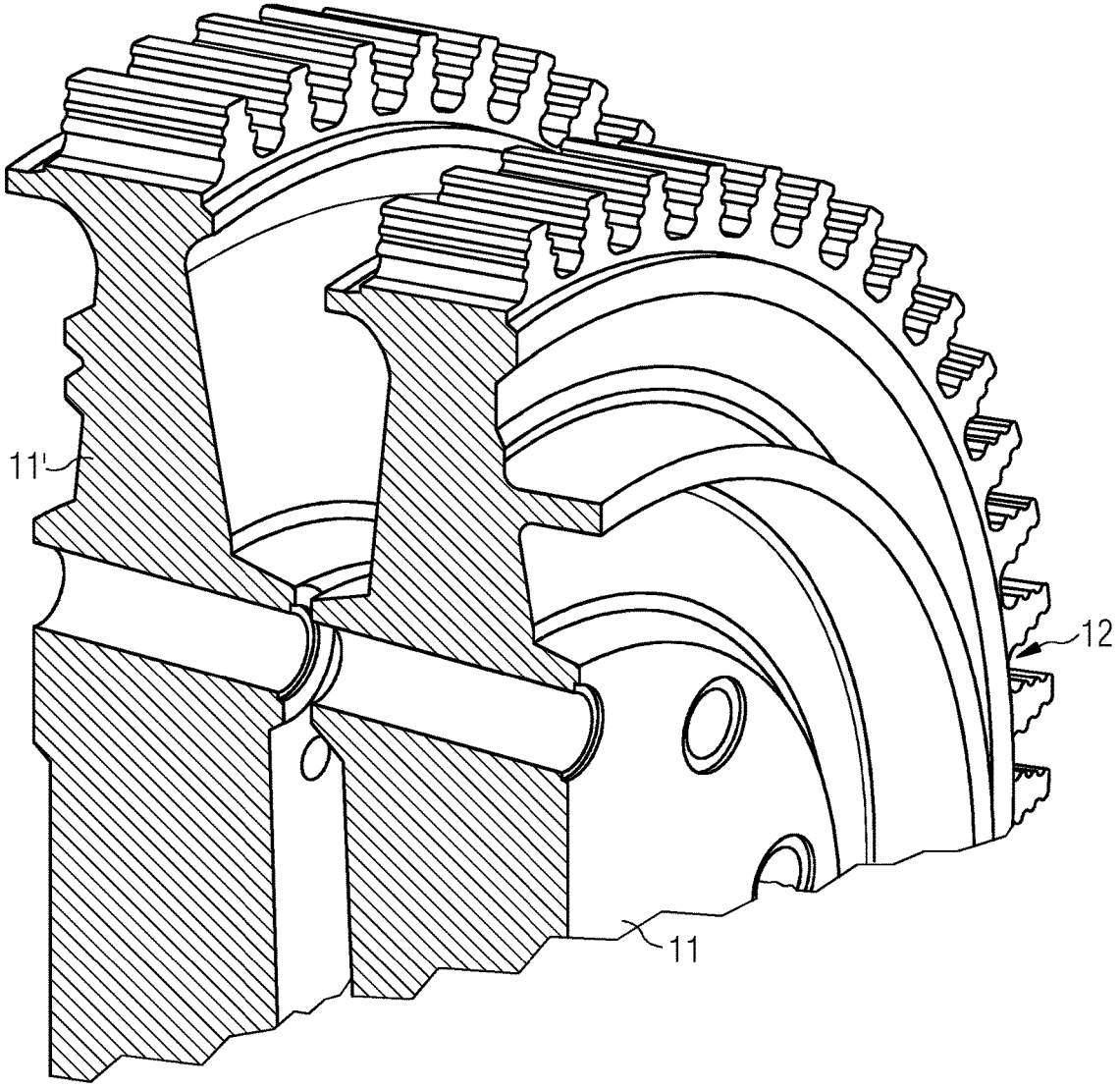
FIG. 1: shows part of prior art rotor discs in a perspective view.

Referring to FIG. 1, parts of two prior art rotor discs, a rotor disc 11 and a further rotor disc 11', are shown in a perspective view. At a radially outer region of the disc 11 a plurality of slots 12 are shown. Each firtree shaped slot is designed such that a firtree shaped root (not shown) fits into it.

Figure 2:
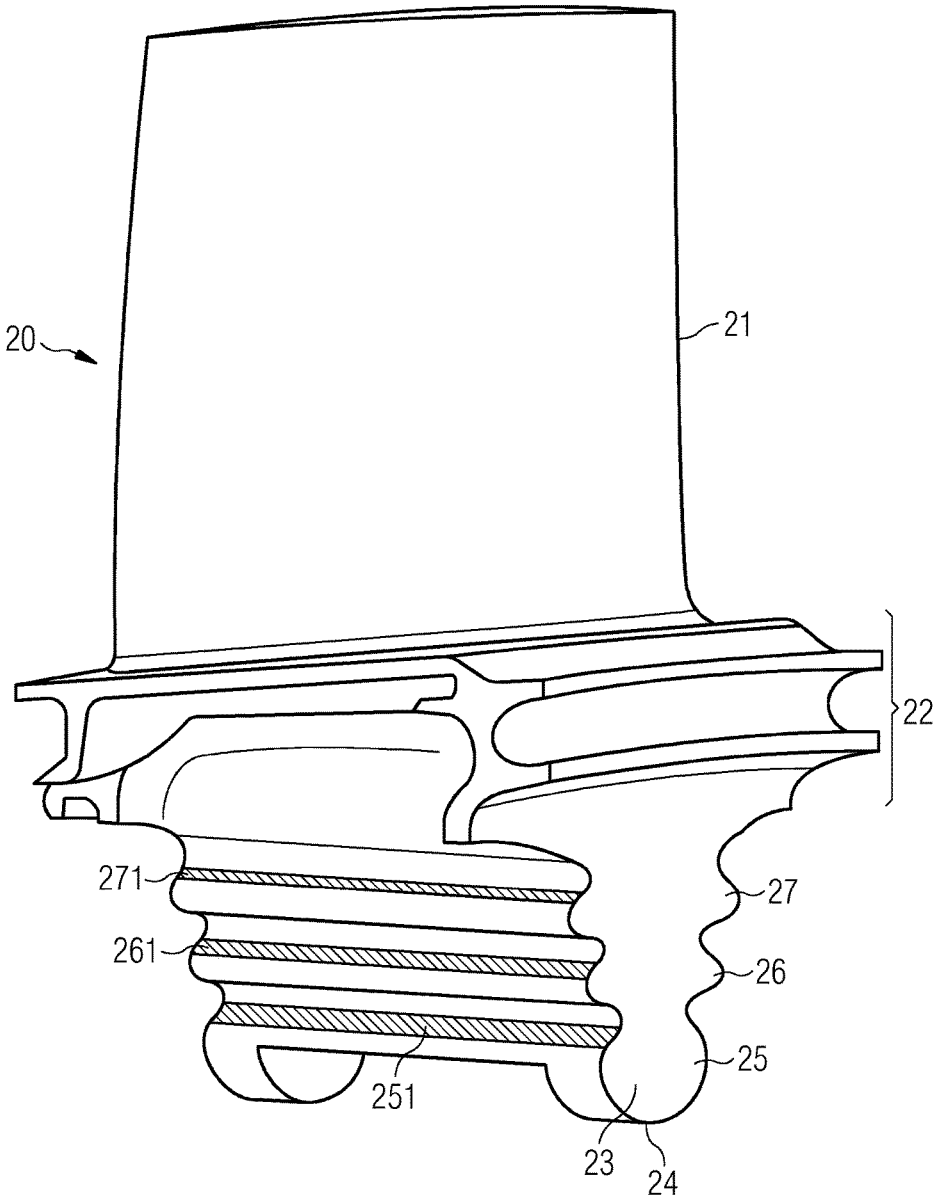
FIG. 2: illustrates a prior art blade in a perspective view.

FIG. 2 shows a prior art blade 20, comprising an aerofoil 21, a platform 22 and a root 23. It should be repeated that the drawings are not to scale: In particular, the aerofoil 21 may be substantially larger in other exemplary embodiments. The root 23 comprises a root bottom 24, a first root lobe 25, a second root lobe 26 and a third root lobe 27. Each root lobe 25, 26, 27 comprises a contact face on its surface section. The first root 25 comprises a first root contact face 251, the second root 26 comprises a second root contact face 261 and the third root 27 comprises a third root contact face 271.

Figure 3:
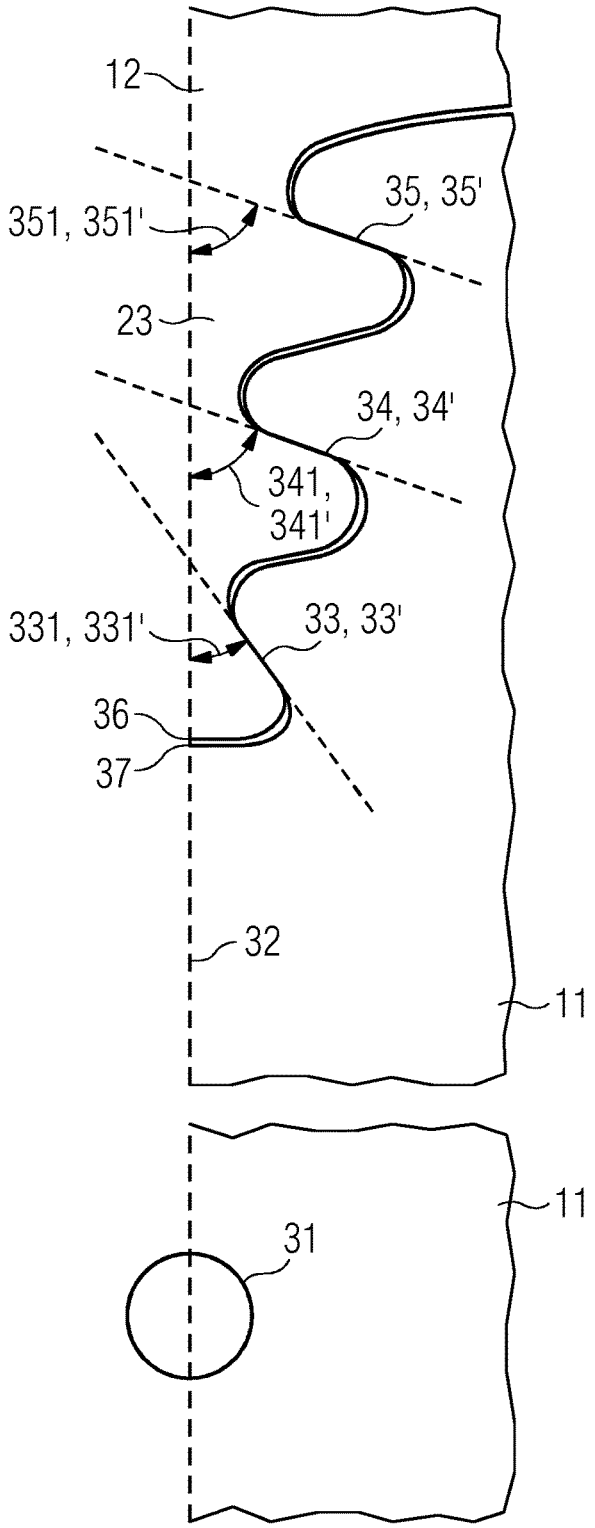
FIG. 3: shows parts of a firtree shaped root and a firtree shaped slot focussing on contact face angles relative to a radial root and slot bottom axis, respectively, in a cross-sectional view.

FIG. 3 depicts parts of a root 23 and a slot 12. This time, a cross-sectional view in a plane perpendicular to the rotor axis 31 is shown. The root 23 comprises a root bottom 36 and exhibits a radial root bottom axis 32, intersecting the rotor axis 31 and the root bottom 36. The root 23 comprises a first root contact face 33 with a first root angle 331 of approximately 45°, a second root contact face 34 with a second root angle 341 of approximately 55° and a third root contact face 35 with a third root angle 351 of approximately 55°, too. The given root angles 331, 341, 351 are exemplarily and apply only to the depicted exemplary embodiment.

The slot 12 comprises a first slot contact face 33' with a first slot angle 331' of approximately 45°, a second slot contact face 34' with a second slot angle 341' of approximately 55° and a third slot contact face 35' with a third slot angle 351' of approximately 55°. In the exemplary embodiment of FIG. 3, the root 23 and the slot 12 comprise the same root angles 331, 341, 351 and slot angles 331', 341', 351', respectively. This fact as well as the given slot angles 331', 341', 351' are exemplarily and apply only to the depicted exemplary embodiment.

In another exemplary embodiment, the root 23 comprises a first root contact face 33 with a first root angle 331 of approximately 43°, a second root contact face 34 with a second root angle 341 of approximately 45° and a third root contact face 35 with a third root angle 351 of approximately 45°, too. Similarly, the slot 12 comprises a first slot contact face 33' with a first slot angle 331' of approximately 43°, a second slot contact face 34' with a second slot angle 341' of approximately 45° and a third slot contact face 35' with a third slot angle 351' of approximately 45°. In this exemplary embodiment, the root 23 and the slot 12 comprise the same root angles 331, 341, 351 and slot angles 331', 341', 351', respectively. This fact as well as the given slot angles 331', 341', 351' are exemplary and apply only to the depicted exemplary embodiment.

As it can be seen, the first contact face angle 331, 331' is smaller than the second contact face angle 341, 341' and the second contact face angle 341, 341' is substantially equal to the third contact face angle 351, 351'.

Figure 4:
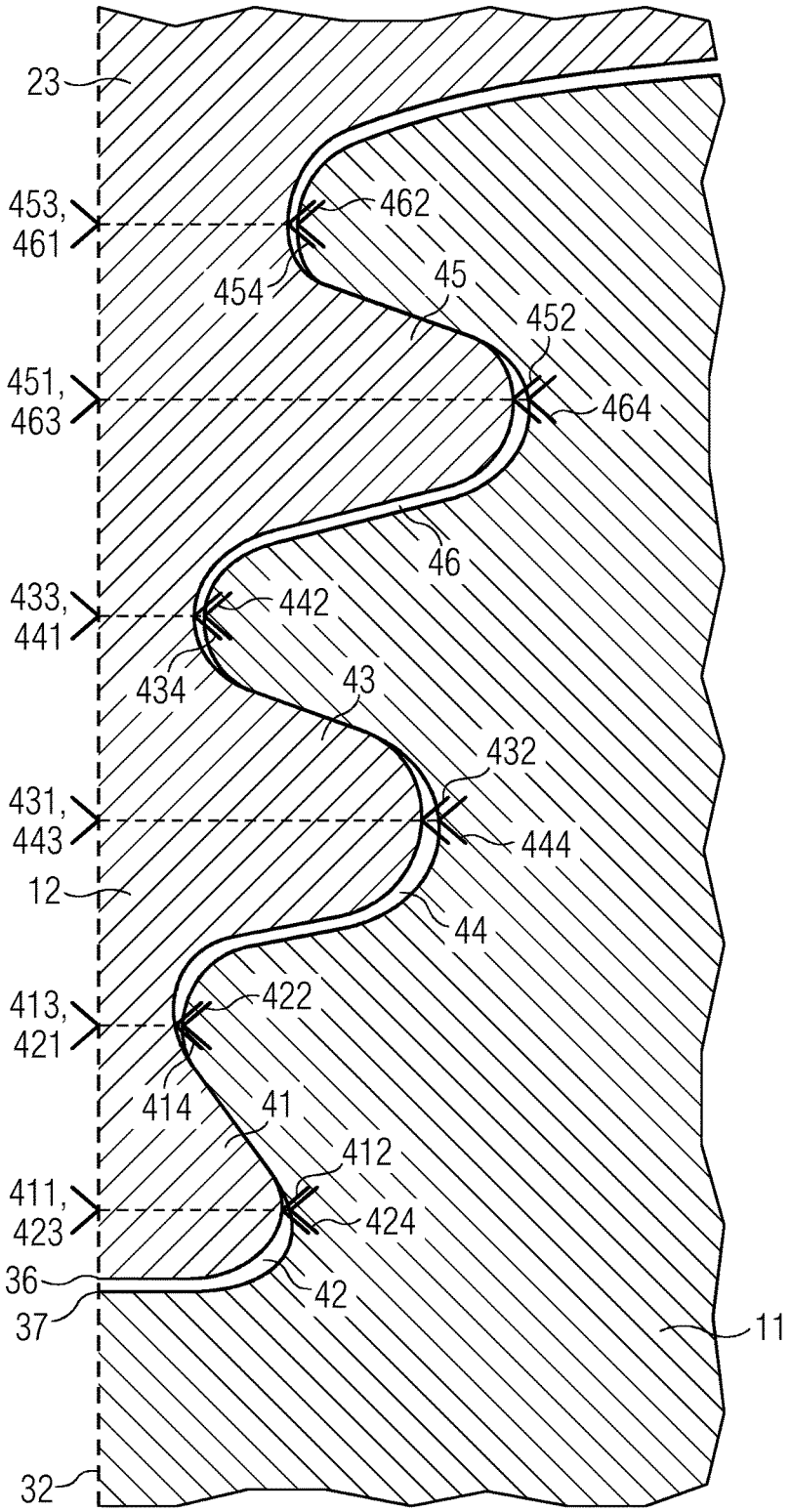
FIG. 4: shows parts of a firtree shaped root and a firtree shaped slot focussing on root and slot distances, respectively, in a cross-sectional view.

Finally, FIG. 4 shows, in a cross-sectional view, parts of a firtree shaped root 23 and a firtree shaped slot 12 focussing on root and slot distances, respectively. The root 23 comprises a root bottom 36 and a first root lobe 41. The first root lobe 41 comprises a portion of the root 23 which is defined by a first area surrounded from the surface section in-between the root bottom 36 and a first local root distance minimum 414, a line segment limited by 413 and 414, and a first projected root lobe line segment, determined by a line segment limited by 36 and 413. Analogously, a second root lobe 43 comprises a portion of the root 23 which is defined by a second area surrounded from the surface section in-between the first local root distance minimum 414 and a second local root distance minimum 434, a line segment limited by 433 and 434, and a second projected root lobe line segment, determined by a line segment limited by 413 and 433. Analogously again, a third root lobe 45 comprises a portion of the root 23 which is defined by a third area surrounded from the surface section in-between the second local root distance minimum 434 and a third local root distance minimum 454, a line segment limited by 453 and 454, and a third projected root lobe line segment, determined by a line segment limited by 433 and 453.

FIG. 4 also illustrates the slot distances. The slot 12 comprises a slot bottom 37 and a first slot lobe 42. The first slot lobe 42 comprises a portion of the slot 12 which is defined by a first area surrounded from the surface section in-between the slot bottom 37 and a first local slot distance minimum 422, a line segment limited by 421 and 422, and a first projected slot lobe line segment, determined by a line segment limited by 37 and 422. Analogously, a second slot lobe 44 comprises a portion of the slot 12 which is defined by a second area surrounded from the surface section in-between the first local slot distance minimum 422 and a second local slot distance minimum 442, a line segment limited by 441 and 442, and a second projected slot lobe line segment, determined by a line segment limited by 421 and 441. Analogously again, a third slot lobe 46 comprises a portion of the slot 12 which is defined by a third area surrounded from the surface section in-between the second local slot distance minimum 442 and a third local slot distance minimum 462, a line segment limited by 461 and 462, and a third projected slot lobe line segment, determined by a line segment limited by 441 and 461.

FIG. 4 furthermore illustrates an exemplary embodiment of the invention with increasing maximum root and slot distances. As can be seen in FIG. 4, the maximum root distance of the first root lobe 41, which is determined by the length of the line segment limited by 411 and 412, is smaller than the maximum root distance of the second root lobe 43, which is determined by the length of the line segment limited by 431 and 432, which in turn is smaller than the maximum root distance of the third root lobe 45, which is determined by the length of the line segment limited by 451 and 452. Analogously, the maximum slot distance of the first slot lobe 42, which is determined by the length of the line segment limited by 423 and 424, is smaller than the maximum slot distance of the second slot lobe 44, which is determined by the length of the line segment limited by 443 and 444, which in turn is smaller than the maximum slot distance of the third slot lobe 46, which is determined by the length of the line segment limited by 463 and 464.

The exemplary embodiments of FIG. 3 and FIG. 4 show contact face angles 331, 331', 341, 341', 351, 351', which particularly are advantageous with respect of the distribution of stress and mechanical load across the root and the slot surfaces.

From a blade root and disc slot design having nominal equal contact face or bearing flank angles to the present invention having a first flank angle 331, 33' smaller rather than the second flank angle 341, 341' and third flank angle 35, 35' means that the first contact face 33, 33' incurs reduced loading and therefore reduced contact stress and reduced bending stress in the first root lobe 25. Consequently, the loading on the second contact face 34, 34' and the third contact face 35, 35' increases and therefore increases contact stress and increased bending stress in the second and third root lobes 26, 27.

In reducing a flank contact angle (331, 331') the associated lobe becomes less stiff (more flexible) by virtue of a reduced cross-sectional area and hence the lobe has less capacity to resist bending from the contact force applied.

This increased flexibility reduces the amount of loading on the flank contact face and consequently there is a redistribution of the total load carried by the root 23 between all lobes with the second and third lobes seeing a relative increase in loading.

It should be appreciated that the loads experienced by the contact faces 33, 33', 34, 34', 35, 35' and the distribution of the total load between contact faces can arise and be influenced by a number of factors which can include the centrifugal loading from the mass of the blade, aerodynamic loading of the blade, thermal strains, radial growth of the disc and hence geometric changes of the disc post/slot.

Tolerances and tolerance build-ups can also cause each lobe's contact faces to experience different loads from nominal design loads. Additionally, distribution of load on the contact faces of each of the lobes may be further influenced by the geometry and therefore flexural behaviour of the root and slot geometries and of the individual lobes themselves. Thus for a rotor disc slot and blade root design having nominally equal contact flank angles the distribution of loads during operation can be significantly different from one another and can be detrimental to the longevity of the root or disc post/slot.

In one case, a blade root and disc slot design having nominal equal contact face or flank angles and where the loading on the first contact face 33, 33' is greater than on the second and third faces, reducing the contact face angle of the first root and slot lobes relative to the second and third contact faces increases flexibility of the first lobe and therefore reduces load on the first lobe. This reduces the amount of load on the contact face and therefore reduces its bedding stress and bending stress in the first lobe 25. The advantageous result is a more beneficial distribution of the total load on the each of the first, second and third contact faces. Of course, where the contact area of root flank and slot flank is different between first, second and third contact flanks then more equal bedding stress or pressure is achievable. This reduction of stress on the first contact face 33, 33' and in first lobe 25 can increase the service life of the blade and/or disc.

In another case, it may be desirable to increase the loading or contact stress and/or bending stress in the first lobe 25. In this case, such an increase is desirable so that there is a redundant failure condition for the root 23. Here the second and third contact faces 34, 34' and 35, 35' are relatively less loaded or have a reduced load from a nominal equally loaded or stressed contact face design. Thus in the event of a failure the second and third contact faces 34, 34' and 35, 35' and their lobes 26, 27 are capable of carrying the total loading at least until the next service interval for example.

It should be noted that the quoted angles are nominal angles and that these angles are subject to tolerances. The contact faces of the root and slot can be referred to as flank faces.

The same objective and advantages for the root may be applied to the disc post(s) that define the disc slots along with the same principles for reducing or increasing one or more the slot contact face angles relative to any other.

The invention claimed is:

1. A turbomachine rotor blade comprising:

a firtree shaped root, arranged to be secured in a turbomachine rotor disc, the rotor disc being rotatable around a rotor axis, wherein in a plane perpendicular to the rotor axis the root comprises a root bottom and a root side;

the root side comprises a plurality of root lobes, each of the root lobes comprises a root contact face, arranged to be in physical contact with a slot contact face of the rotor disc;

the plurality of root lobes comprises a first root lobe with a first root contact face, a second root lobe with a second root contact face and a third root lobe with a third root contact face, the first root lobe being closer to the root bottom than the second root lobe and the second root lobe being closer to the root bottom than the third root lobe;

the first root contact face is angled relative to a radial root bottom axis with a first root angle, the radial root bottom axis being defined by a line through the rotor axis and the root bottom;

the second root contact face is angled relative to the radial root bottom axis with a second root angle; and the third root contact face is angled relative to the radial root bottom axis with a third root angle;

wherein any one or more of the first root angle or the second root angle or the third root angle is in the range 1° to 15° of any of the other root angles; and wherein the first root angle is greater than the second root angle and greater than the third root angle, effective to increase stress in the first root lobe relative to the second root lobe and third root lobe, so that in the event of a failure of the first root lobe, the second root lobe and third root lobe are capable of carrying a total loading.

2. The turbomachine rotor blade according to claim 1, wherein any one or more of the first root angle or the second root angle or the third root angle is in the range 1° to 5° of any of the other root angles.

3. The turbomachine rotor blade according to claim 1, wherein the second root angle is substantially equal to the third root angle.

4. The turbomachine rotor blade according to claim 1, wherein the first root angle is 2° greater than the second root angle or third root angle.

5. The turbomachine rotor blade according to claim 1, wherein the first root angle is 2° greater than the second root angle and the second root angle is equal to the third root angle.

6. The turbomachine rotor blade according to claim 1, wherein the root comprises a further root side, the further root side comprising a plurality of further root lobes, and the root side and the further root side being circumferentially opposite to each other.

7. The turbomachine rotor blade according to claim 6, wherein the plurality of root lobes comprises a first root shape and the plurality of further root lobes comprises a second root shape, the first root shape being a copy, flipped at the radial root bottom axis, of the second root shape.

8. The turbomachine rotor blade according to claim 1, wherein each of the root lobes has a maximum root distance to the radial root bottom axis, the root distance being defined by the length of a root line segment between a surface section of a root lobe and an axis section of the radial root bottom axis, the root line segment being perpendicular to the radial root bottom axis; and wherein the maximum root distance of the first root lobe is smaller than the maximum root distance of the second root lobe and/or the maximum root distance of the second root lobe is smaller than the maximum root distance of the third root lobe.

9. The turbomachine rotor blade according to claim 1, wherein the turbomachine rotor blade is part of a gas turbine engine, part of a turbine section of the gas turbine engine and/or part of a compressor section of the gas turbine engine.

10. A turbomachine rotor comprising the turbomachine rotor blade according to claim 1, and the turbomachine rotor disc comprising:

a firtree shaped slot, the rotor disc being rotatable around the rotor axis;

wherein in the plane perpendicular to the rotor axis the slot comprises a slot bottom and a slot side;

the slot side comprises a plurality of slot lobes, each of the slot lobes comprises the slot contact face, arranged to be in physical contact with the root contact face of the turbomachine rotor blade;

the plurality of slot lobes comprises a first slot lobe with a first slot contact face, a second slot lobe with a second slot contact face and a third slot lobe with a third slot contact face, the first slot lobe being closer to the slot bottom than the second slot lobe and the second slot lobe being closer to the slot bottom than the third slot lobe;

the first slot contact face is angled relative to a radial slot bottom axis with a first slot angle, the radial slot bottom axis being defined by a line through the rotor axis and the slot bottom;

the second slot contact face is angled relative to the radial slot bottom axis with a second slot angle; and the third slot contact face is angled relative to the radial slot bottom axis with a third slot angle; characterised in that any one or more of the first slot angle or the second slot angle or the third slot angle is in the range 1° to 15° of any of the other slot angles.

11. The turbomachine rotor according to claim 10, wherein the physical contact between the first root contact face and the first slot contact face and/or between the second root contact face and the second slot contact face and/or between the third root contact face and the third slot contact face is established during operation of the turbomachine rotor.

12. A gas turbine engine, comprising a turbomachine rotor according to claim 10.

13. A turbomachine rotor disc comprising:

a firtree shaped slot, the rotor disc being rotatable around a rotor axis;

wherein in a plane perpendicular to the rotor axis the slot comprises a slot bottom and a slot side;

the slot side comprises a plurality of slot lobes, each of the slot lobes comprises a slot contact face, arranged to be in physical contact with a root contact face of a turbomachine rotor blade;

the plurality of slot lobes comprises a first slot lobe with a first slot contact face, a second slot lobe with a second slot contact face and a third slot lobe with a third slot contact face, the first slot lobe being closer to the slot bottom than the second slot lobe and the second slot lobe being closer to the slot bottom than the third slot lobe;

the first slot contact face is angled relative to a radial slot bottom axis with a first slot angle, the radial slot bottom axis being defined by a line through the rotor axis and the slot bottom;

the second slot contact face is angled relative to the radial slot bottom axis with a second slot angle; and the third slot contact face is angled relative to the radial slot bottom axis with a third slot angle; characterised in that any one or more of the first slot angle or the second slot angle or the third slot angle is in the range 1° to 15° of any of the other slot angles; and wherein the first slot angle is greater than the second slot angle and greater than the third slot angle.

14. The turbomachine rotor disc according to claim 13, wherein any one or more of the first slot angle or the second slot angle or the third slot angle is in the range 1° to 5° of any of the other slot angles.

15. The turbomachine rotor disc according to claim 13, wherein the first slot angle is greater than the second slot angle and the second slot angle is substantially equal to the third slot angle.

16. The turbomachine rotor disc according to claim 13, wherein the first slot angle is 2° greater than the second slot angle or third slot angle.

17. The turbomachine rotor disc according to claim 13, wherein the first slot angle is 2° greater than the second slot angle and the second slot angle is equal to the third slot angle.

18. The turbomachine rotor disc according to claim 13, wherein the slot comprises a further slot side, the further slot side comprising a plurality of further slot lobes, and the slot side and the further slot side being circumferentially opposite to each other.

19. The turbomachine rotor disc according to claim 18, wherein the plurality of slot lobes comprises a first slot shape and the plurality of further slot lobes comprises a second slot shape;

the first slot shape being a copy, flipped at the radial slot bottom axis, of the second slot shape.

20. The turbomachine rotor disc according to claim 13, wherein each of the slot lobes has a maximum slot distance to the radial slot bottom axis, the slot distance being defined by the length of a slot line segment between a surface section of a slot lobe and an axis section of the radial slot bottom axis, the slot line segment being perpendicular to the radial slot bottom axis; and wherein the maximum slot distance of the first slot lobe is smaller than the maximum slot distance of the second slot lobe and/or the maximum slot distance of the second slot lobe is smaller than the maximum slot distance of the third slot lobe.

21. The turbomachine rotor disc according to claim 13, wherein the turbomachine rotor disc is part of a gas turbine engine, part of a turbine section of the gas turbine engine and/or part of a compressor section of the gas turbine engine.

* * * * *